United States Patent [19]

Chujo et al.

[11] Patent Number: 4,538,575

[45] Date of Patent: Sep. 3, 1985

[54] DEVICE FOR CONTROLLABLY HEATING OXYGEN SENSOR

[75] Inventors: Yoshiki Chujo, Susono; Hiroshi Noguchi, Gotenba, both of Japan

[73] Assignee: Toyota Jidosha Kabushiki Kaisha, Toyota, Japan

[21] Appl. No.: 511,235

[22] Filed: Jul. 6, 1983

[30] Foreign Application Priority Data

Apr. 13, 1983 [JP] Japan ..... 58-63752

[51] Int. Cl.[3] ..... F02B 3/00; F02B 33/00

[52] U.S. Cl. ..... 123/440; 73/23; 204/431

[58] Field of Search ..... 123/440, 489; 73/23; 204/195 S

[56] References Cited

U.S. PATENT DOCUMENTS

| | | | |
|---|---|---|---|
| 3,868,846 | 3/1975 | Kushida | 73/23 |
| 3,948,081 | 4/1976 | Wessel . | |
| 4,198,939 | 4/1980 | Masaki | 123/440 |
| 4,328,780 | 5/1982 | Andrew | 123/440 |
| 4,332,225 | 6/1982 | Cox . | |
| 4,354,468 | 10/1982 | Sone | 123/489 |
| 4,365,604 | 12/1982 | Sone . | |

*Primary Examiner*—R. B. Cox

*Attorney, Agent, or Firm*—Oblon, Fisher, Spivak, McClelland & Maier

[57] ABSTRACT

Pulse current having a certain cycle is supplied to an electric heater in an oxygen sensor for exhaust gas. Duty ratio of this pulse current is controlled in relation to the amplitude of voltage and current applied to the heater to thereby maintain power consumption of the heater per unit time at a constant one. Also this duty may be corrected on the basis of parameters for running an internal combustion engine.

22 Claims, 8 Drawing Figures

DEVICE FOR CONTROLLABLY HEATING OXYGEN SENSOR

BACKGROUND OF THE INVENTION

1. Field of the Invention

This inventicn relates to a device for controllably heating an oxygen sersor provided in an exhaust pipe of an internal combustion engine and heated by an electric heater to generate the output proportional to the oxygen concentration in exhaust gas.

b 2. Description of the Prior Art

Since oxygen concentration in exhaust gas of an internal combusticn engine is satisfactorily correlative to air fuel ratio in the region of the air fuel ratio larger than the theoretical one, i.e. lean mixture, the air fuel ratio in the exhaust gas can be detected accurately by measuring the oxygen concentration in the exhaust gas in such region. For an oxygen sensor measuring the oxygen concentration in the exhaust gas in such region is used a sensor comprising a bottomed tubular sensor element consisting a permeable measuring electrode provided at the exhaust gas-to-be-measured side, a permeable opposite electrode provided at the reference gas side, for example, the atmosphere side having known oxygen concentration and a solid electrolyte, for example, stabilized zirconia interposed between both electrodes. When current is supplied between both electrodes in such oxygen sensor, the oxygen can be moved through the electrolyte in one direction and the current can be maintained approximately at a specified value in a region of applied voltage by coating this permeable measuring electrode with a microporous diffusion resistance layer having oxygen sending capacity smaller than that of the permeable measuring electrode. This current value is referred to threshold current value which linearly varies approximately in proportion to oxygen concentration so that the oxygen concentration can be continuously detected from the change in the current value. On the other hand, in this oxygen sensor, it is necessary for generating current value proportional to the oxygen concentration in exhaust gas with a certain applied voltage to heat the sensor element to at least about 650° C. and maintain it at the active condition.

For this end, an electric heater is provided in a tubular sensor element of the oxygen sensor and supplied with current from a storage battery as power source mounted on a vehicle to heat the sensor element. However, the voltage of the battery varies normally over the wide range from 10 to 16 V corresponding to the running condition of the engine and the charged condition of the battery. Thus, when power is supplied from the battery directly to the heater, the sensor element may be overheated, causing thermal deterioration. FIG. 1 shows the relationship between the applied voltage and element temperature of the heater. As mentioned above, the sensor element is inert at temperature lower than 650° C., but may be subjected to thermal deterioration in at least 850° C. Thus, it is necessary for maintaining the temperature of the sensor element within proper range of 650°-800° C. to maintain the applied voltage of the heater within the range of 10–14 V.

For this end, a temperature sensor such as thermocouple, thermistor or the like are mounted directly on the outer or inner surface of the sensor element of the oxygen sensor to detect the temperature of the sensor element, and current supplied from the battery to the heater is controllably turned on or off on the basis of the output signal of the temperature sensor so as to maintain the sensor element within the range of proper temperature. However, this heating control brings about a complicate construction of the oxygen sensor assembly in connection of the temperature sensor and lead wire, leading-out of lead wire, etc, presenting problems in reliability of the function.

Though a power supply circuit may be considered to apply a certain voltage to the heater for maintaining the sensor element of the oxygen sensor at a proper temperature, it has disadvantages in that the scale of the circuit is enlarged and cost is substantially increased.

SUMMARY OF THE INVENTION

An object of the present invention is to prevent a sensor element of an oxygen sensor from overheat to improve durability thereof without use of a temperature sensor such as thermocouple and thermistor while maintaining the temperature of the sensor element within a proper range.

The object and features of the invention may be understood with reference to the following detailed description of an illustrative embodiment of the present invention, taken together with the accompanying drawings.

According to the present invention, current in the form of pulse having a specified cycle is supplied to a heater, and the ratio of the pulse width to the cycle is controlled on the basis of the product of signal related to the heater voltage and signal related to the heater current so that power consumption of the heater per unit time is maintained within a predetermined range. For the heater voltage may be used approximately supply voltage, i.e. voltage of battery mounted on an vehicle as a power source. When voltage applied to the heater, i.e. voltage drop in the heater is used for the heater voltage, control is carried out accurately. The heater current is obtained from the voltage drop in a resistance inserted in the heater circuit for measuring current. Control of supplying current to the heater is carried out by an electronic switch, for example, power transistor.

Further, according to this invention, supply of current to the heater can be controlled on the basis of the product of signal related to said heater voltage and signal related to the heater current and parameters for funning the engine. For the parameters for running the engine can be used the rotational frequency of the engine, intake air amount, intake pressure, cooling water temperature, oil temperature, opening of a throttle valve, vehicle speed and shift position of a transmission.

The present invention has advantages as follows: first it can maintain the exothermic amount of the heater per unit time at a certain value irrespective of variation of battery voltage or change of heater resistance with the passage of time and thereby the function of the oxygen sensor is ensured while the thermal deterioration of the heater caused by applied overvoltage is eliminated to elongate the life of the heater. Also, the temperature of sensor element of the oxygen sensor does not need to be directly detected by the use of the temperature sensor, and the construction of the sensor assembly can be simplified. The simplification of the construction of the oxygen sensor improves the reliability of the oxygen sensor. Further, since current supply is controlled in relation to the parameters for running the engine, adverse effects of high exhaust temperature on the oxygen sensor can be eliminated.

DETAILED DESCRIPTION OF PREFERRED EMBODIMENT

Figure 2:
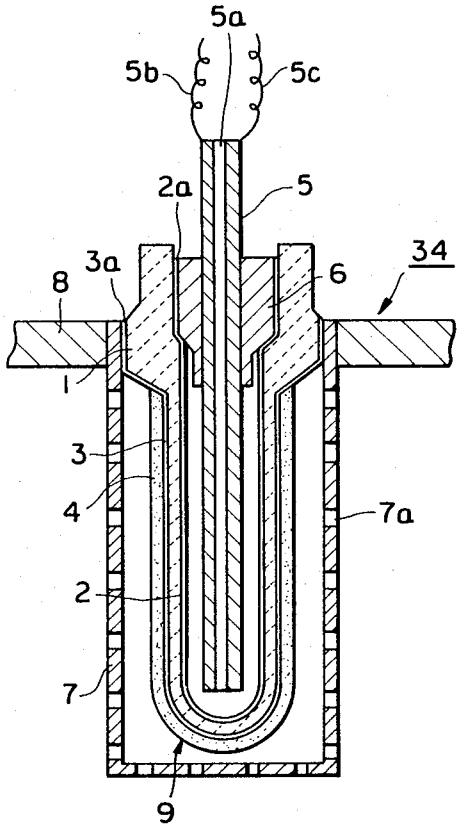
FIG. 2 is a longitudinal sectional view of the oxygen sensor.
Figure 1:
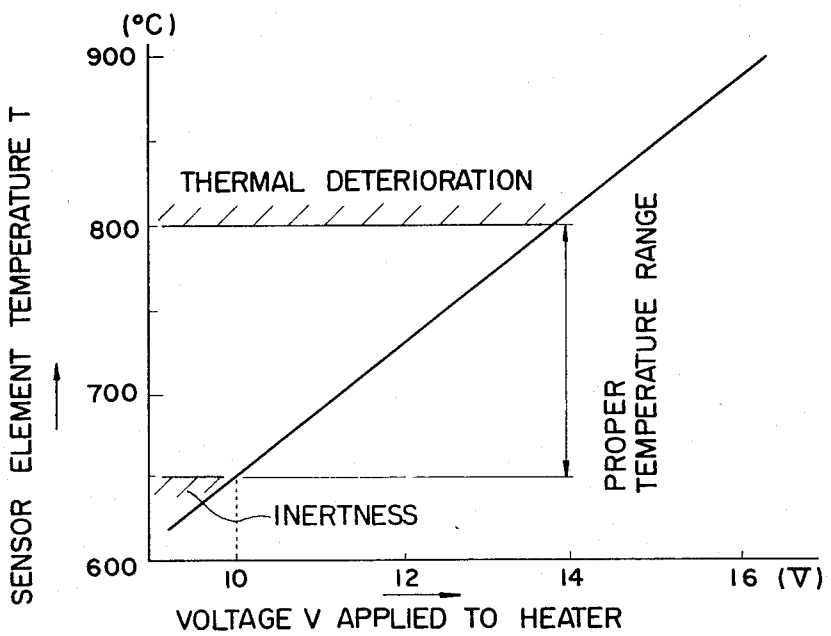
FIG. 1 is a diagram showing the relationship between voltage and temperature of an oxygen sensor.

FIG. 2 shows an oxygen sensor 34 used according to the present invention in which a bottomed cylindrical, oxygen ion-conductive solid electrolyte 1 made of zirconia is covered with a permeable platinum film electrode 2 having the inner and outer surfaces as anode and a permeable platinum film electrode 3 having the inner and outer surfaces as cathode. Between lead wires 2*a*, 3*a* connected to these electrodes 2 and 3 is applied direct current voltage. A perforated ceramic layer 4 as a diffusion resistance layer is provided on the outer surface of the cathode 3. To heat the sensor element 9 thus formed, a tubular ceramic heater 5 having an air hole 5*a* leading to the atmosphere in the center extends through an insulating bushing 6 and projects into an sensor element 9 to receive current through lead wires 5*b*, 5*c*. The sensor element 9 is received in a casing 7 having a plurality of holes 7*a* and extends through a wall 8 of an exhaust path, for example, exhaust pipe to project into the exhaust pipe.

Figure 3:
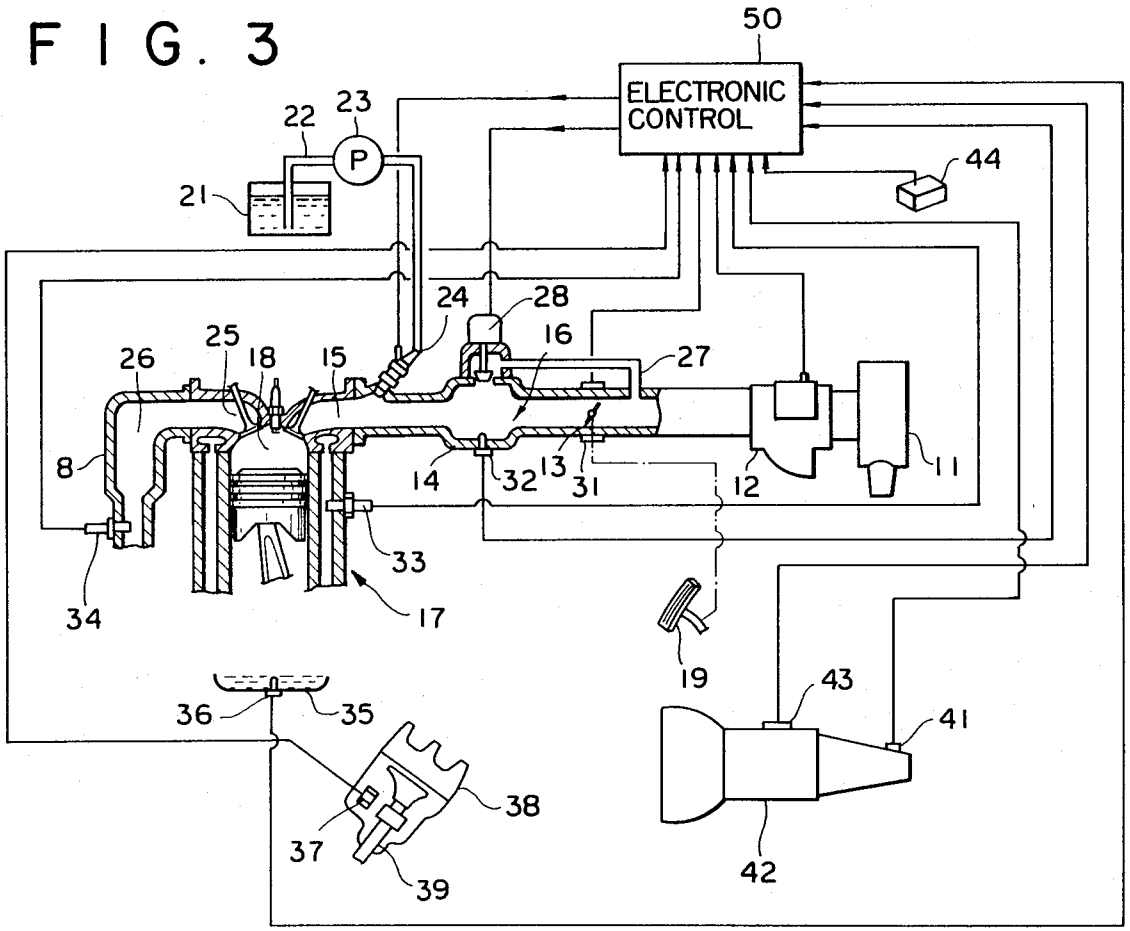
FIG. 3 is a diagrammatic constitutional drawing of an internal combustion engine provided with the oxygen sensor.
Figure 4:
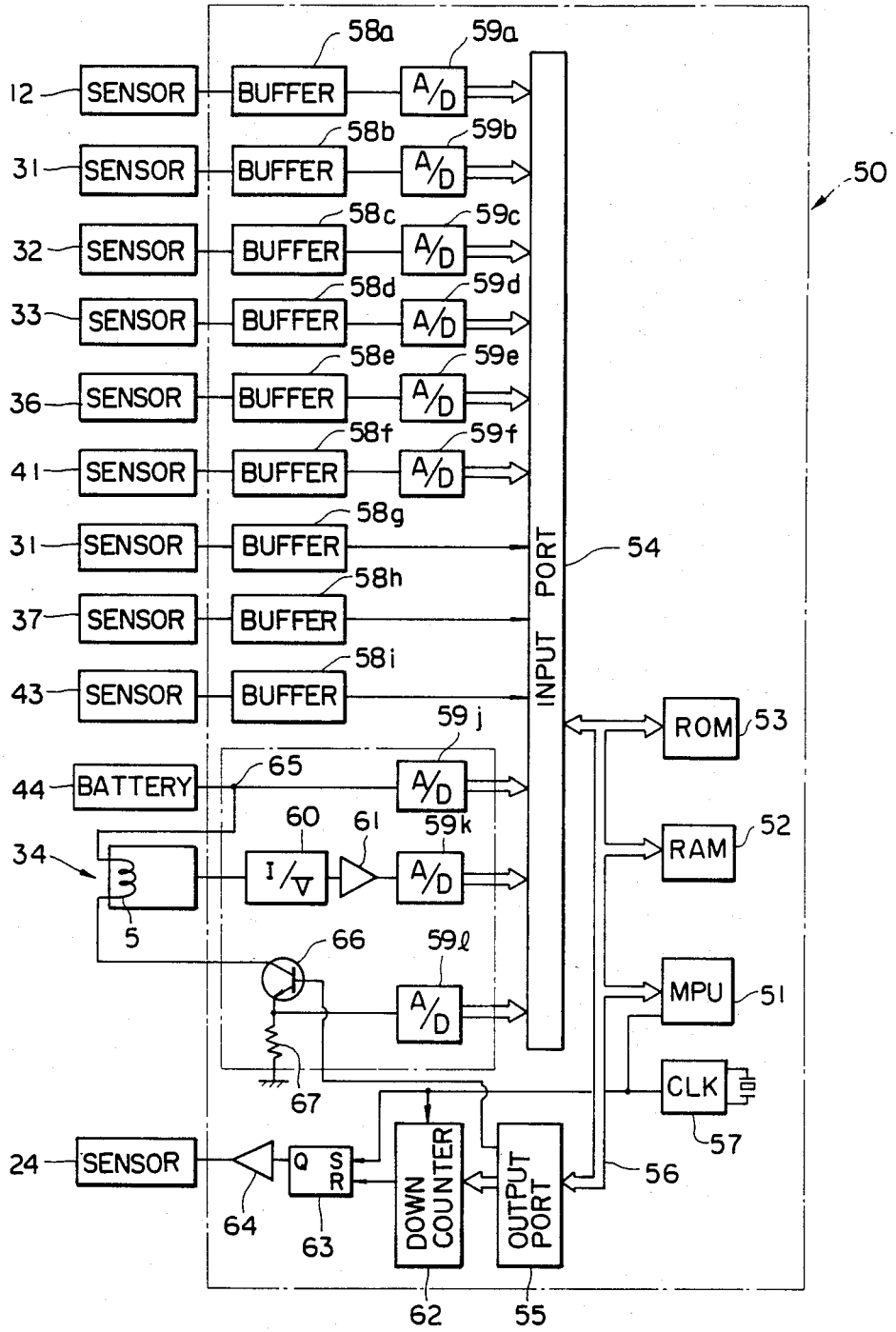
FIG. 4 is a block diagram of an electronic control unit in the engine.

FIG. 3 shows an internal combustion engine equipped with an electronic control fuel injection device provided with such oxygen sensor. Air sucked from an air cleaner 11 is sucked into a combustion chamber 18 of an engine body 17 through an air flow meter 12 as intake air amount sensor, a throttle valve 13, a surge tank 14 and a intake path 16 including an intake port 15. The throttle valve 13 is connected to an accelerator pedal 19 in a cab. Fuel sucked out of a fuel tank 21 through a path 22 is pressurized by a pump 23 and injected into an intake port 15 through a injector 24. Exhaust gas produced by the combustion of air-fuel mixture in the combustion chamber 18 is purged to the atmosphere through an exhaust port 25 and an exhaust pipe 26. A bypassing flow controlling valve 28 in a bypass path 27 for bypassing the intake path 16 at the throttle valve 13 controls the sectional area of flow in the bypass path 27 to maintain the rotational frequency of the engine in idling at a constant one. A throttle sensor 31 comprising a throttle switch changed over from turned-on to turned-off condition when the throttle valve 13 is opened from the fully closed position and a potentiometer varied in relation to the opening of the throttle valve 13 detects the opening of the throttle valve 13. An intake pressure sensor 32 provided in the surge tank 14 detects intake pressure and a water temperature sensor 33 mounted on a cylinder block detects cooling water temperature of the engine. An oxygen sensor 34 (FIG. 2) is mounted on the exhaust pipe 26. In an oil pan 35 of the engine is provided an oil temperature sensor 36. A crank angle sensor 37 for measuring the rotational frequency N of the engine and discriminating cylinders detects the crank angle of a crankshaft (not shown) from the rotation of a shaft 39 of a distributor 38 connected to said crankshaft of the engine body 17 and generates pulses respectively every time the crank angle (CA) varies by 360° and 30°. A vehicle speed sensor 41 detects the rotational frequency of an output shaft of an automatic transmission 42, i.e. vehicle speed. The transmission 42 is provided also with a shift position sensor 43. A storage battery as power source mounted on the vehicle is designated by 44. The outputs of the sensors 12, 31, 32, 33, 34, 36, 37 41 and 43 and the voltage of the battery 44 are sent to the input of an electronic control unit 50. FIG. 4 shows an example of the electronic control unit 50. This control unit 50 comprises digital computers, and a microprocessor (hereinafter called MPU) 51 for carrying out various computational processes, a random access memory (hereinafter called RAM) 52, a read-only memory (hereinafter called ROM) 53 for storing control program, table, various constants, etc., an input port 54 and an output port 55 are interconnected through a two-way data bus 56. Further, various clock signal generator (hereinafter called CLK) 57 are provided. The air flow meter 12, potentiometer of the throttle sensor 31, intake pressure sensor 32, water temperature sensor 33, oil temperature sensor 36 and vehicle speed sensor 41 are respectively connected to the input port 54 through buffers 58*a*, 58*b*, 58*c*, 58*d*, 58*e* and 58*f* and analog-digital converters (hereinafter called A/D) 59*a*, 59*b*, 59*c*, 59*d*, 59*d* and 59*f*. A throttle switch of the throttle sensor 31, crank angle sensor 37 and shift position sensor 43 are connected to the input port 54 respectively through buffers 58*g*, 58*h* and 58*i*. The intake pressure sensor 32 generates the output voltage proportional to the intake pressure produced in the surge tank 14, and this output voltage is converted to the corresponding binary digit in A/D 59*c* and sent to the input of MPU 51 through the input port 54 and bus 56. On the other hand, the crank angle sensor 37 as rotational frequency sensor generates pulses every time the crankshaft is rotated by a predetermined crank angle, and these pulses are sent to the input of MPU 51 through the input port 54 and bus 56. In IMU 51, the rotational frequency of the engine is computed from the output pulse of the crank angle sensor 37. The throttle switch of the throttle sensor 31 connected to the input port 54 through the buffer 58*g* transfers from the turned-on to the turned-off condition when the throttle valve 13 begins to open from the idling position, and signals generated at that time are sent to the input of MPU 51. Also, the oxygen sensor 34 is connected to the input port 54 through a current-voltage converter (hereinafter called I/V) 60, an amplifier 61 and A/D 59K. The output current of the oxygen sensor 34 proportional to oxygen concentration in exhaust gas is converted to the corresponding voltage in I/V 60 and further converted to the corresponding binary digit in A/D 59K, this binary digit being sent to the input of MPU 51 through the input port 54 and the bus 56. In ROM 53 are stored previously the relationship between the threshold current value of the oxygen sensor 34 and oxygen concentration, i.e. air fuel ratio. In this case, the threshold current value is converted to the corresponding voltage through I/V 60 so that the relationship between this voltage and air fuel ratio in the form of data table or function is stored in ROM 53. On the output port 55 provided to generate the output data for operating the fuel injector 24 are written bynary digit data from MPU 51 through the bus 56. The respective output terminals of the output port 55 are connected to the respective corresponding input terminals of a down counter 62. This down-counter 62 is provided to convert the binary digit data written from MPU 51 to the corresponding length of time. The down-counter 62 starts the down-count of data sent from the output port 55 according to the clock signal of CLK 57 and completes the count when the count value reaches zero to generate the completion signal of count to the output terminal. A reset input terminal R of S-R flip-flop 63 is connected to the output terminal of the down-counter 62 and a set input terminal S connected to CLK 57, the output terminal Q being connected to the fuel injector 24 through an electronic amplifying circuit 64. Thus, the fuel injector 24 will be energized while the down-counter 62 receives the clock signal at the set input terminal S to carry out the down-count.

Voltage $V_B$ at the terminal 65 of the battery 44 for energizing the heater 5 is conyerted to digital signal by A/D 59*j* and then sent to the input of MPU 51 through the input port 54. The other end of the heater 5 having one end connected to the terminal of the battery 44 is connected to the collector of NPN power transistor 66 and the emitter of the transistor 66 is earthed through a current measuring resistance 67. Current flowing through the heater 5 in the conductive condition of transistor 66 cause voltage drop $V_R$ across the current measuring resistance 67 and this voltage drop proportional to heater current is converted to digital signal by A/D 59*l* and thereafter sent to the input or MPU 51 through the input port 54. From the outputs of A/D 59*j* and 59*l* sent to the input of MPU 51 every predetermined time, i.e. voltage supplied to the heater (battery voltage) $V_B$ and heater current I in the form of pulse, power P is computed in MPU 51. In this case, the supply voltage $V_B$ is employed for heater voltage V, neglecting voltage drop $V_T$ in the transistor 66 and voltage drop $V_R$ in the resistance 67. Namely since $V_T$ and $V_R$ are small compared with $V_B$ they can be neglected without any practical troubles. From this power P obtained every predetermined time can be obtained correction factor K for the reference power Po according to the following formula;

$$K = \frac{1}{P/Po} = Po/P$$

The ratio t/T of energizing time t predetermined so as to maintain power consumption $P_T$ of the heater per unit time approximately constant to cycle T of heater energization, i.e. the relationship between energizing duty ratio and correction factor K in the form of data table or function is stored in ROM 53. To control the power transistor 66, the binary digit data are written on the output port 55 from MPU 51 through the bus 56. Thus, the transistor 66 gets conductive to energize the heater 5 only in a period of time corresponding to the energizing duty ratio.

Figure 5:
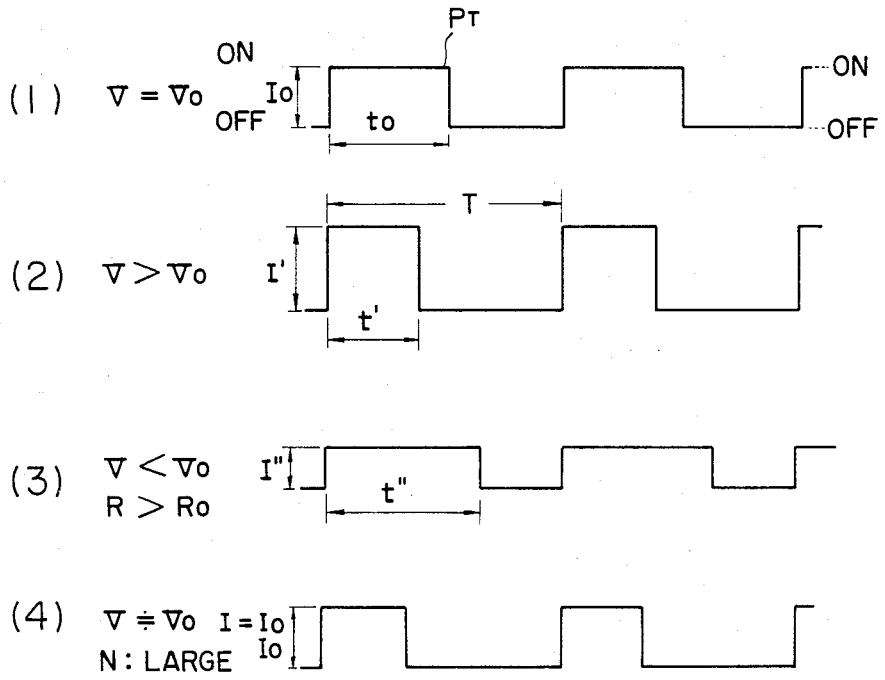
FIG. 5 is a timing chart of current pulse of the oxygen sensor.
Figure 6:
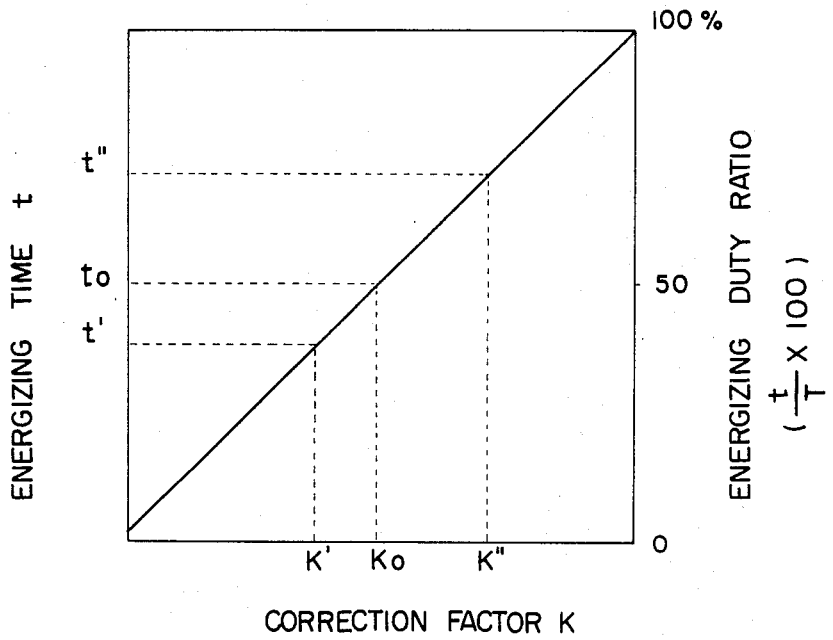
FIG. 6 is a diagram showing correction factor.

FIG. 5 shows a timing chart related to the energization of the heater. The heater energizing condition under which the heater voltage V for the reference power Po is the reference value Vo is represented by (1) in the drawing. Namely, the heater current Io is detected, and the energizing time to is obtained from the correction factor Ko according to FIG. 6. The heater 5 is energized only for the time $t_o$ such that the power consumption P of the heater per unit time becomes constant in cycle T of turning on and off the heater. The heater energization under which the heater voltage V is higher than the reference value Vo due to the variation of the battery voltage is represented by (2) in FIG. 5. Since the heater current is increased by the increase of voltage ($I' > Io$) and thereby the supply power P is increased, the correction factor K' becomes less than Ko (FIG. 6) so that the heater energizing time t is controlled to provide $t' < t_o$ and lessens the energizing duty ratio for maintaining $P_T$ constant. Further, (3) in FIG. 5 represents the energizing condition under which the heater voltage V is lower than the reference value Vo or the resistance R of the heater is larger than the reference value Ro by the variation of the heater with the passage of time. In this case, $K'' > K$ and thereby $t'' > ta$. Hence the energizing duty ratio is enlarged to maintain $P_T$ constant.

Figure 7:
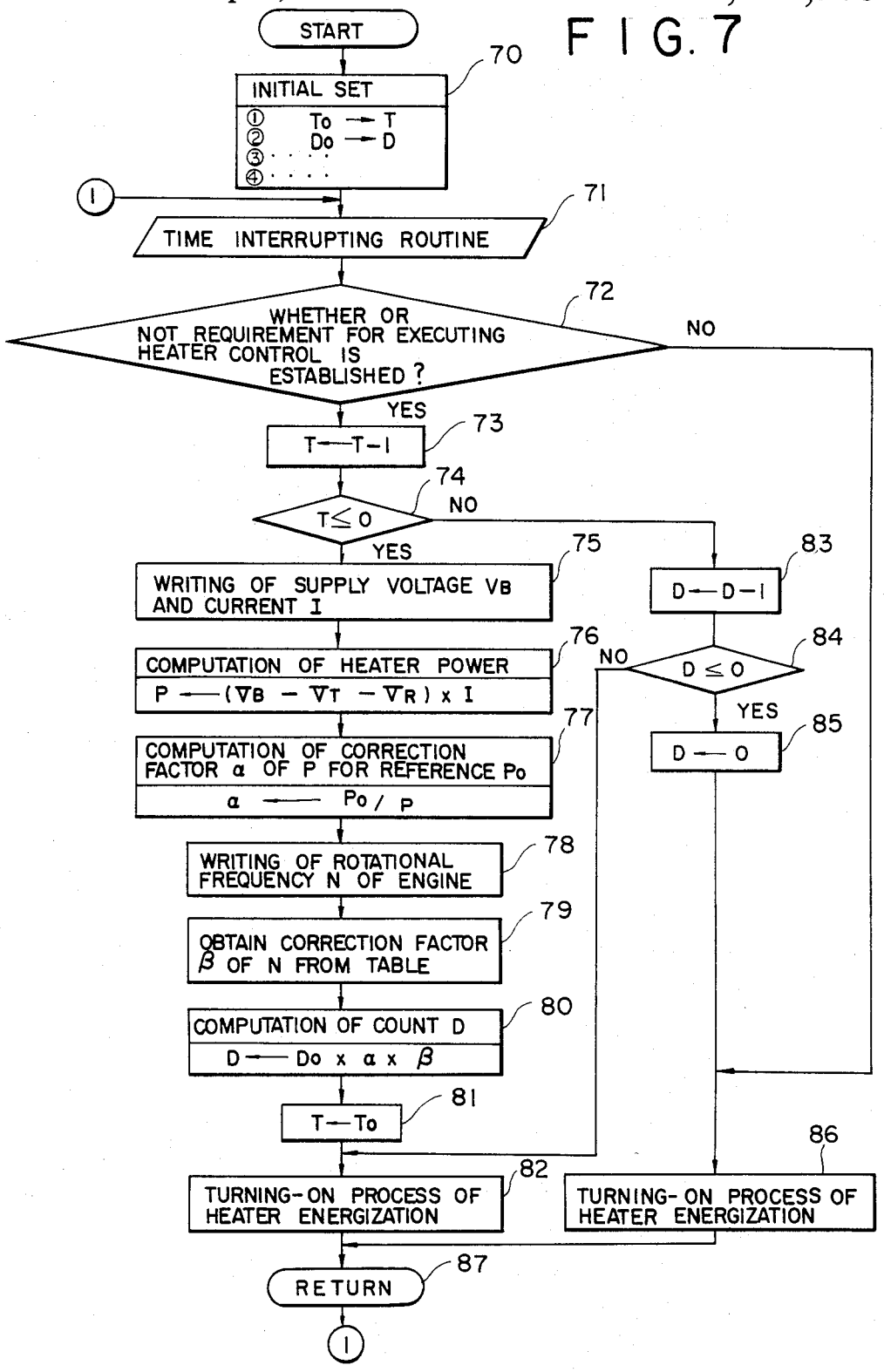
FIG. 7 is a flow chart for explaining the function of the oxygen sensor.

Now, in high speed running condition of the engine, the temperature of exhaust gas becomes higher. Thus, this fact should be considered in cotrolling the energization of the heater. FIG. 7 shows a program of this control. Here, voltage applied to the heater (voltage drop in the heater) is employed for the heater voltage. As soon as an ignition switch of the engine is closed, the electronic control unit 50 is in the operative condition. Time T taken from time point of on-off shift of energizing the heater 5 to that of the next on-off of same is called duty control cycle and assumed to be 20 m second - 1 second for example. Count number $T_o$ corresponding to this cycle is set to the down-counter, and count number $D_o$ corresponding to the heater energizing time (duty ratio) in the reference voltage Vo of the storage battery and the reference current $I_o$ of the heater is set to the down-counter (step 70). In step 71, interruption is carried out every predetermined time, for example every 4 ms and thereby processes in steps 72–86 which will be described later will be carried out every 4 ms. In step 72 is judged whether or not a requirement for executing the heater control is established. For example when the requirement for executing the heater control is established at 60° C. or more of cooling water temperature of the engine, the down-counter carries out the down-count in step 73, and whether or not the count number T of the down-counter for duty ratio control cycle shows $T \leqq O$ is judged in step 74. If $T \leqq O$ is not judged, the down-counter for duty ratio carries out the down-count in step 83, and whether or not the count number D of this counter shows $D \leqq O$ is judged in step 84. When $D \leqq O$ is not shown, the heater 5 is energized in step 82. When $D \leqq O$ in step 84, the count number D of the down-counter is made O in step 85 and the energization of the heater 5 is stopped in step 86.

Figure 8:
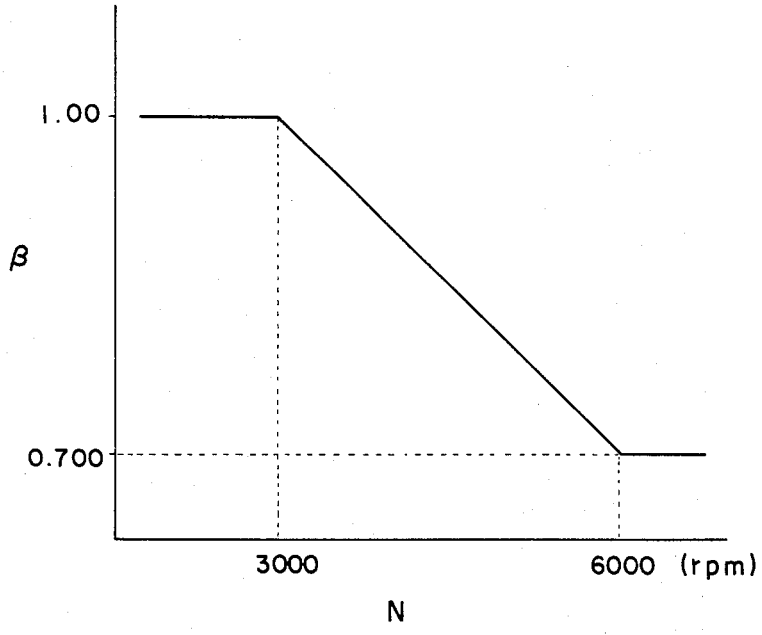
FIG. 8 is a diagram showing a second correction factor.

When the count number T os down-counter $\leqq O$ is judged in step 74 after several times of interruption are carried out, the supply voltage (battery voltage) $V_B$ and the heater current I to the heater 5 are written on RAM 52 in step 75. In step 76, voltage V applied to the heater is computed according to the formula $V - V_B - V_T - V_R$ from the supply voltage $V_B$, voltage drop $V_T$ in the power transistor 66 for controlling the heater energization and voltage drop $V_R$ in the resistance 67, and further heater power $P = VI$ is computed from the voltage V applied to the heater and the heater current I. In step 77 is computed correction factor $\alpha$ (=K) of P for the reference power Po. In step 78 is written the rotational frequency N of the engine on RAM 52. In step 79, a second correction factor $\beta$ decreasing as the rotational frequency increases within a certain range of the rotational frequency is obtained from such function as shown in FIG. 8 and is written on RAM 52. The correction factor shown in FIG. 8 is stored in ROM 53. In step 80, the reference duty ratio Do is multiplied by the correction factors $\alpha$ and $\beta$ and stored in the down counter. In step 81, the count number to corresponding to duty control cycle is set to the down counter and thereafter advance is made to step 82 to energize the heater. Further advance is made to step 86 to stop the energization of the heater if the requirement for executing the heater control is not established in step 72. The heater energizing condition in the large rotational frequency of the engine is shown in (4) of FIG. 5. Namely, in the heater voltage V and heater current I close to the reference value Vo and Io is shown the current pulse when the rotational frequency N of the engine is high.

Further, for parameters representing the running condition of the engine having high temperature of exhaust may be also used, in addition to the rotational frequency of the engine, intake air amount detected by the air flow meter 12, intake pressure detected by the intake pressure sensor 32, cooling water temperature of the engine detected by the cooling water temperature sensor 33, oil temperature detected by the oil temperature sensor 36, the opening or position of throttle detected by the throttle sensor 31 and shift position detected by the shift position sensor 43 of the transmission 42.

What is claimed is:

1. A device for controllably heating an oxygen sensor provided in an exhaust pipe of an internal combustion engine comprising;

a means for supplying heat to said oxygen sensor;

means for generating from said oxygen sensor an output proportional to the oxygen concentration in the exhaust gas from said internal combustion engine and the air/fuel ratio which is controlled in the lean mixture regions by means of an oxygen sensor;

means for providing pulse current to the heater wherein said heater is controlled in relation to the heater voltage and the heater current and wherein the current in the form of a pulse has a specific cycle which is supplied to said heater and the ratio of the pulse width to the cycle is controlled on the basis of the product of the signal related to the heater voltage and the signal related to the heater current, such that the power consumption of the heater per unit time is maintained within a predetermined range.

2. A device for controllably heating an oxygen sensor provided in an exhaust pipes of an internal combustion engine comprising;

means for providing heat by way of electricity provided to said sensor;

means for providing an output from said oxygen sensor which generates an output proportional to the oxygen concentration in the exhaust gas and air/fuel ratio which is controlled in the lean mixture region by means of said oxygen sensor;

means for providing a pulse current to the heater such that the pulse current is controlled in relation to the heater voltage and the heater current and wherein the current has a specified cycle which is supplied to said heater and the ratio of the pulse width of said cycle is controlled on the basis of the product signal related to the heater voltage and the signal related to the heater current and signals related to parameters for running the engine such that the power consumption of said heater per unit time remains within a predetermined range.

3. A device for controllably heating an oxygen sensor as defined in claim 1, wherein supply voltage is employed approximately for the heater voltage.

4. A device for controllably heating an oxygen sensor as defined in claims 1 or 3, wherein storage battery voltage is employed approximately for the heater voltage.

5. A device for controllably heating an oxygen sensor as defined in claim 1, wherein voltage drop in the heater is employed for the heater voltage.

6. A device for controllably heating an oxygen sensor as defined in claim 1, wherein voltage drop in a current measuring resistance inserted in the heater circuit is employed for the heater current.

7. A device for controllably heating an oxygen sensor as defined in claim 1, wherein the energization of the device is controlled by an electronic switch inserted in the heater circuit.

8. A device for controllably heating an oxygen sensor as defined in claim 7, wherein a power transistor is used for the electronic switch.

9. A device for controllably heating an oxygen sensor as defined in claim 1, wherain said pulses width is obtained such that the ratio of the heater voltage times the heater current in the actual condition to the predetermined electric power consumption is determined by the reference heater voltage times the reference heater current is calculated and the reference duty in the predetermined electric power consumption constant is multiplied by said ratio.

10. A device for controllably heating an oxygen sensor as defined in claims 2 or 9, wherein voltage drop in the heater is employed for the heater voltage.

11. A device for controllably heating an oxygen sensor as defined in claim 2, wherein the rotational frequency of the engine is employed for the running parameter.

12. A device for controllably heating an oxygen sensor as defined in claim 2, wherein intake air amount of the engine is employed for the running parameter.

13. A device for controllably heating an oxygen sensor as defined in claim 2, wherein intake pressure of the engine is employed for the running parameter.

14. A device for controllably heating an oxygen sensor as defined in claim 2, wherein cooling water temperature of the engine is employed for the running parameter.

15. A device for controllably heating an oxygen sensor as defined in claim 2, wherein oil temperature of the engine is employed for the running parameter.

16. A device for controllably heating an oxygen sensor as defined in claim 2, wherein the opening of the throttle valve is employed for the running parameter.

17. A device for controllably heating an oxygen sensor as defined in claim 2, wherein vehicle speed is employed for the running parameter.

18. A device for controll,ably heating an oxygen sensor as defined in claim 2, wherein a shift position of a transmission is employed for the running parameter.

19. A device for controllably heating an oxygen sensor as defined in claim 9, wherein said duty ratio is performed by means of a counter contained in an interrupt routine which is repeated in every predetermined cycle.

20. A device for controllably heating an oxygen sensor as defined in claim 12, further comprising; zirconia element electrode and wherein said zirconia element electrode and said heater means are completely insulated.

21. A device for controllably heating an oxygen sensor as defined in claim 2, wherein the duty ratio is performed by means of a counter in an interrupt routine which is repeated in every predetermined cycle.

22. A device for controllably heating an oxygen sensor as defined in claim 2 or 21, further comprising;

means for controlling the duty ratio obtained from the result of the multiplication of the ratio of actual heater voltage times the actual heater current over the reference heater voltage times reference heater current to each engine parameter by the duty ratio.

* * * * *